US011526122B2

(12) United States Patent
Josiah et al.

(10) Patent No.: US 11,526,122 B2
(45) Date of Patent: Dec. 13, 2022

(54) METHOD AND SYSTEM FOR CONVERTING A TONER CARTRIDGE PRINTER

(71) Applicant: UI Technologies, Inc., Las Vegas, NV (US)

(72) Inventors: Michael Raymond Josiah, North Patchogue, NY (US); Joseph Dovi, Lake Grove, NY (US)

(73) Assignee: UI Technologies, Inc., Las Vegas, NV (US)

( * ) Notice: Subject to any disclaimer, the term of this patent is extended or adjusted under 35 U.S.C. 154(b) by 5 days.

(21) Appl. No.: 17/194,620

(22) Filed: Mar. 8, 2021

(65) Prior Publication Data

US 2021/0191291 A1 Jun. 24, 2021

Related U.S. Application Data

(63) Continuation-in-part of application No. 17/079,151, filed on Oct. 23, 2020, now Pat. No. 11,409,207, (Continued)

(51) Int. Cl.
*G03G 21/18* (2006.01)
*G03G 15/08* (2006.01)
(Continued)

(52) U.S. Cl.
CPC ..... *G03G 21/181* (2013.01); *G03G 15/0121* (2013.01); *G03G 15/0863* (2013.01);
(Continued)

(58) Field of Classification Search
CPC ..... G03G 15/6585; G03G 15/0863; G03G 15/0894; G03G 2215/00987; G03G 15/0178; G03G 21/181
See application file for complete search history.

(56) References Cited

U.S. PATENT DOCUMENTS 6,249,655 B1 6/2001 Baek
2003/0007154 A1* 1/2003 Tandon ..... G01J 3/513 356/406

(Continued)

FOREIGN PATENT DOCUMENTS

JP 2009196118 9/2009

OTHER PUBLICATIONS

The International Searching Authority, International Search Report, dated Aug. 31, 2021, 4 pages, United States.

(Continued)

*Primary Examiner* — Jessica L Eley

(74) *Attorney, Agent, or Firm* — Kevin Schraven; Anooj Patel; Hankin Patent Law, APC

(57) ABSTRACT

A method of converting a CMYW toner printer to a CMYK printer that prints with black toner, comprising the steps: providing a CMYW toner printer; wherein the CMYW toner printer has four starting toner printing cartridges; wherein the four starting toner printing cartridges comprise a white toner printing cartridge, a cyan toner printing cartridge, a magenta toner printing cartridge, and a yellow toner printing cartridge; removing one or more of the four starting toner printing cartridges from the CMYW toner printer, such that there are one or more empty toner cartridge slots; providing a black toner printing cartridge that are each filled with black toner; and installing the black toner printing cartridge into the one or more empty toner cartridge slots.

12 Claims, 5 Drawing Sheets

Related U.S. Application Data which is a continuation-in-part of application No. 16/402,718, filed on May 3, 2019, now abandoned, which is a continuation-in-part of application No. 15/944,750, filed on Apr. 3, 2018, now Pat. No. 10,687,203, and a continuation-in-part of application No. 15/800,482, filed on Nov. 1, 2017, now Pat. No. 10,310,446, and a continuation-in-part of application No. 15/722,562, filed on Oct. 2, 2017, now Pat. No. 10,324,395, and a continuation-in-part of application No. 15/722,503, filed on Oct. 2, 2017, now Pat. No. 10,228,637, said application No. 15/944,750 is a continuation-in-part of application No. 15/722,503, filed on Oct. 2, 2017, now Pat. No. 10,228,637, said application No. 15/800,482 is a continuation-in-part of application No. 15/408,186, filed on Jan. 17, 2017, now Pat. No. 9,835,968, and a continuation-in-part of application No. 15/286,875, filed on Oct. 6, 2016, now Pat. No. 9,835,981, and a continuation-in-part of application No. 15/286,943, filed on Oct. 6, 2016, now Pat. No. 9,835,982, and a continuation-in-part of application No. 15/286,998, filed on Oct. 6, 2016, now Pat. No. 9,835,983, and a continuation-in-part of application No. 14/879,548, filed on Oct. 9, 2015, now Pat. No. 9,488,932, and a continuation-in-part of application No. 14/731,785, filed on Jun. 5, 2015, now Pat. No. 9,383,684.

(60) Provisional application No. 62/470,639, filed on Mar. 13, 2017.

(51) Int. Cl.
*G03G 15/01* (2006.01)
*G03G 15/00* (2006.01)

(52) U.S. Cl.
CPC ..... *G03G 15/0877* (2013.01); *G03G 15/6585* (2013.01); *G03G 15/0178* (2013.01)

(56) References Cited

U.S. PATENT DOCUMENTS

| | | | | |
|---|---|---|---|---|
| 2013/0108345 | A1* | 5/2013 | Yamamoto | G03G 15/5087 400/76 |
| 2013/0330522 | A1 | 12/2013 | Suzuki | |
| 2013/0343779 | A1* | 12/2013 | Nicodem | B41J 2/17559 399/109 |

OTHER PUBLICATIONS

The International Searching Authority, International Search Report, dated Sep. 1, 2021, 4 pages, United States.
The International Searching Authority, Written Opinion of the International Searching Authority, dated Aug. 31, 2021, 4 pages, United States.
The International Searching Authority, Written Opinion of the International Searching Authority, dated Sep. 1, 2021, 4 pages, United States.

* cited by examiner

METHOD AND SYSTEM FOR CONVERTING A TONER CARTRIDGE PRINTER

CROSS-REFERENCE TO RELATED APPLICATIONS

This patent application is a Continuation-in-Part application of U.S. Non-Provisional patent application Ser. No. 17/079,151, titled A Method For Converting A Toner Cartridge, filed on Oct. 23, 2020, the contents of which are expressly incorporated herein by this incorporated herein by this reference as though set forth in their entirety and to which priority is claimed. U.S. Non-Provisional patent application Ser. No. 17/079,151 is a Continuation-in-Part application of U.S. Non-Provisional patent application Ser. No. 16/402,718, titled Method For Converting A Toner Cartridge Printer To A Security Toner Printer, filed on May 3, 2019, the contents of which are expressly incorporated herein by this incorporated herein by this reference as though set forth in their entirety and to which priority is claimed. U.S. Non-Provisional patent application Ser. No. 16/402,718 is a Continuation-in-Part application of U.S. Non-Provisional patent application Ser. No. 15/800,482, titled Method For Converting A Toner Cartridge Printer To A Sublimation Toner Printer, filed on Nov. 1, 2017, now U.S. Pat. No. 10,310,446, the contents of which are expressly incorporated herein by this reference as though set forth in their entirety and to which priority is claimed. U.S. Non-Provisional patent application Ser. No. 15/800,482 takes priority from U.S. Provisional Patent Application No. 62/470,639, filed on Mar. 13, 2017, titled Toner Cartridge Printer Devices, Systems, and Methods, the contents of which are expressly incorporated herein by this reference as though set forth in their entirety and to which priority is claimed. U.S. Non-Provisional patent application Ser. No. 16/402,718 is also a Continuation-in-Part application of U.S. Non-Provisional patent application Ser. No. 15/722,562, titled Toner Cartridge Printer Devices, Systems, And Methods For Under Printing, filed on Oct. 2, 2017, now U.S. Pat. No. 10,324,395, the contents of which are expressly incorporated herein by this reference as though set forth in their entirety and to which priority is claimed. U.S. Non-Provisional patent application Ser. No. 15/800,482, is a Continuation-in-Part of the following U.S. Non-Provisional patent application Nos., which means that this U.S. patent application is also a Continuation in Part of the following U.S. Non-Provisional patent application Nos.: (1) Ser. No. 15/408,186, filed on Jan. 17, 2017, titled, Toner Cartridge Printer Devices, Systems, and Methods For Over Printing and Under Printing, now U.S. Pat. No. 9,835,968; (2) Ser. No. 15/286,998, filed on Oct. 6, 2016, titled, Method and System for Converting a Toner Cartridge Printer to a Double White Toner Printer, now U.S. Pat. No. 9,835,983; (3) Ser. No. 15/286,943, filed on Oct. 6, 2016, titled Method And System For Converting A Toner Cartridge Printer To A White, Clear, Metallic, Fluorescent, Or Light Toner Printer, now U.S. Pat. No. 9,835,982; (4) Ser. No. 15/286,875, filed on Oct. 6, 2016, titled, Method and System for Converting a Toner Cartridge Printer to a Metallic, Clear Fluorescent, or Light Toner Printer, now U.S. Pat. No. 9,835,981; (5) Ser. No. 14/879,548, now U.S. Pat. No. 9,488,932, filed on Oct. 9, 2015, titled, Method and System for Converting a Toner Cartridge Printer to a White, Clear, or Fluorescent Toner Printer; (6) Ser. No. 14/731,785, now U.S. Pat. No. 9,383,684, filed on Jun. 5, 2015, titled, Method and System for Converting a Toner Cartridge Printer to a White Toner Printer; the contents of all of which are expressly incorporated herein by this reference as though set forth in their entirety and to which priority is claimed as Continuation-in-Part. U.S. Non-Provisional patent application Ser. No. 16/402,718 is also a Continuation-in-Part application of U.S. Non-Provisional patent application Ser. No. 15/944,750, titled Method And System For Converting A Toner Cartridge Printer, filed on May 31, 2018, now U.S. Pat. No. 10,649,372, the contents of which are expressly incorporated herein by this reference as though set forth in their entirety and to which priority is claimed. U.S. Non-Provisional patent application Ser. No. 16/402,718 is also a Continuation-in-Part application of U.S. Non-Provisional patent application Ser. No. 15/722,503, filed on Oct. 17, 2017, titled Method and System For Converting A Toner Cartridge Printer to a Metallic Or Light Toner Printer, now U.S. Pat. No. 10,229,637. U.S. Non-Provisional patent application Ser. No. 15/944,750, is a Continuation-in-Part of U.S. Non-Provisional patent application Ser. No. 15/722,503, filed on Oct. 17, 2017, titled Method And System For Converting A Toner Cartridge Printer To A Metallic Or Light Toner Printer, now U.S. Pat. No. 10,228,637.

FIELD OF USE

The present disclosure relates generally to printer cartridge replacement. More specifically, this disclosure relates to methods and systems of converting a white toner cartridge printer to a printer that prints with black toner.

BACKGROUND

Cyan (C), Magenta (M), Yellow (Y), and White (W) (or CMYW) laser or Light Emitting Diode (LED) type printers come standard with Cyan, Magenta, Yellow, and White toner and/or drum cartridges. However, CMYW toner printers are generally unable to be converted to print with toner other than cyan, magenta, yellow, and white, as these printers lack the appropriate toner and/or drum cartridges and the appropriate raster image processor (RIP) software for printing cartridge re-mapping.

Thus, there is a need for a system and method for converting a standard CMYW (four cartridge) toner printer to print using black.

SUMMARY OF EMBODIMENTS

To minimize the limitations in the cited references, and to minimize other limitations that will become apparent upon reading and understanding the present specification, the toner printer converting, refilling, and refurbishment systems and methods disclosed herein preferably allow a user to convert a CMYW printer into a CMYK or one that prints using black toner.

In various embodiments, the methods and systems may be used to convert a four cartridge white toner cartridge(s) and/or drum(s) printing machine to a printing machine that prints with black toner.

In one embodiment, a white CMYW toner cartridge printer is converted by replacing one of the standard color or white toner printing cartridges, from any slot, with a black toner cartridge and then using raster image processing (RIP) software to match or set in which printer slot each of the cartridges resides.

In another embodiment, a standard white toner cartridge printer is converted by replacing the color or white toner printing cartridge in the last toner printing cartridge position with a black toner cartridge.

In one embodiment, the cartridge re-mapping is used to allow a black toner printing cartridge to be put in the "W" (White) slot (which may be the first slot in the printer) of a CYMW printer and the CYM cartridges are all in their original slots.

In one embodiment the printing cartridge integrated circuits (chips) may be swapped along with the toner printing cartridges, and the RIP software is configured to ensure that the correct colors print regardless of which slot the colors or black toner cartridges are placed.

The RIP software may allow or feature color rasterization, which enables the printer to use less toner by selectively removing pixels to use less toner. This feature gives a nicer feel and ads more durability to the finished product.

One embodiment may be a method of converting a CMYW toner printer to print with black toners, comprising the steps: providing a CMYW toner printer; wherein the CMYW toner printer has four starting toner printing cartridges; wherein the four starting toner printing cartridges comprise a white toner printing cartridge, a cyan toner printing cartridge, a magenta toner printing cartridge, and a yellow toner printing cartridge; removing one or more of the four starting toner printing cartridges from the CMYW toner printer, such that there are one or more empty toner cartridge slots; providing a black toner printing cartridges that are each filled with one type of one or more non-standard toners; and installing the black toner printing cartridge into the one or more empty toner cartridge slots. The method may also comprise providing raster image processor (RIP) software, such that the CMYW toner printer is able to incorporate the black toner into one or more images printed by the CMYW toner printer. The RIP software allows for remapping of the CMYW toner printer. The black toner printing cartridge may each have an appropriate chip, such that when the black toner printing cartridge is installed in the CMYW printer the appropriate chip is configured to allow the black toner printing cartridges to be recognized by the CMYW toner printer. The CMYW toner printer may be a laser toner printer. The CMYW toner printer may be a LED toner printer.

One embodiment may be a method of converting a CMYW toner printer to print with a non-standard toner, comprising the steps: providing a CMYW toner printer; wherein the CMYW toner printer has four starting printing cartridges; wherein the four starting printing cartridges comprise a white toner printing cartridge, a cyan toner printing cartridge, a magenta toner printing cartridge, and a yellow toner printing cartridge; removing the white toner printing cartridge from the CMYW toner printer, such that there is an empty toner cartridge slot; providing a black toner printing cartridge that is filled with black toner; and installing the black toner printing cartridge into the empty toner cartridge slot. The method may also comprise the step of providing raster image processor (RIP) software, such that the CMYW toner printer is able to incorporate the black toner into one or more images printed by the CMYW toner printer. The RIP software may allow for remapping of the CMYW toner printer. The black toner printing cartridge may have an appropriate chip, such that when the black toner printing cartridge is installed in the CMYW printer the appropriate chip is configured to allow the black toner printing cartridge to be recognized by the CMYW toner printer. The CMYW toner printer may be a laser toner printer. The CMYW toner printer may be a LED toner printer.

In some embodiments, once the non-standard toner cartridges have been swapped in, the printer settings and/or RIP software may allow the user to utilize those swapped in toners by telling the printer to print using the toners that were removed. So, for example, if the cyan toner cartridge was removed, then the printer may print 100% cyan to print using the black swapped in cartridge.

It is an object of the present system and method for converting a CMYW toner cartridge printer into a printer that is a CMYK toner cartridge printer.

It is an object of the present system and method for raster image processor software to provide cartridge remapping, which allows the system to print using a black toner from different cartridge positions.

In one embodiment of the system and method may use new empty or recycled empty toner cartridges that have been pre-cleaned and filed with a black toner. In this embodiment the original cartridge(s) that are removed do not have to be cleaned and filed, they can immediately be replaced by a prefilled new or used cartridge.

Other features and advantages inherent in the system and method for converting a standard toner cartridge printer into white, metallic, or light toner printer claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps, which are illustrated. When the same numeral appears in different drawings, it refers to the same or like components or steps.

DETAILED DESCRIPTION OF THE ILLUSTRATIVE EMBODIMENTS

Figure 1:
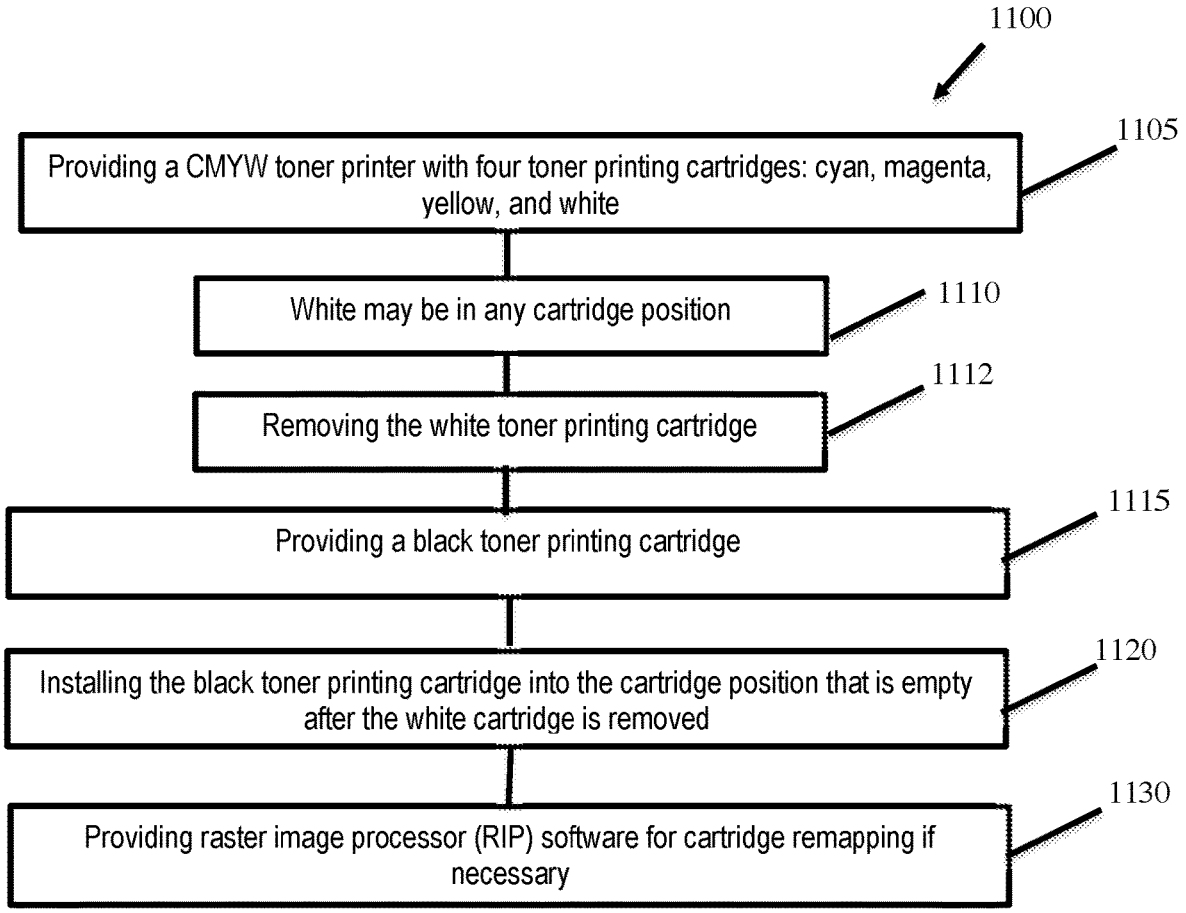
FIG. 1 is a flow block diagram of one embodiment of the method of converting a CMYW toner printer to print with a black toner with a single cartridge conversion.

In the following detailed description, numerous specific details are set forth in order to provide a thorough understanding of various aspects of one or more embodiments. However, these embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 15% of the indicated number or range of numbers. In one embodiment, the term "approximately" and "about", refer to a deviance of between 0.0001-40% from the indicated number or range of numbers.

In the following description, certain terminology is used to describe certain features of one or more embodiments. For purposes of the specification, unless otherwise specified, the term "printing cartridge(s)" generally refers to a toner cartridge, a laser toner cartridge, a LED toner cartridge, a drum cartridge, and/or a combined toner and drum cartridge.

As used herein, the term "toner" generally refers to a powder, particulate, or dry ink that is used in laser printers, printers, and printing machines to form the printed text and images on the medium being printed. Generally, toner particles are melted by the heat of a fuser, and bound to the media.

Regarding a CMYW printer, the letter "W" preferably stands for white.

Regarding a CMYK printer, the letter "K" refers to a standard (or non-standard) black toner.

The present specification discloses a system and method for converting a four cartridge white toner cartridge printer to a CMYK (color and black) toner printer. The method and system for converting a toner cartridge printer to a black and color toner printer preferably requires no special or dedicated printer drivers.

The present method and system for converting a white toner cartridge printer to a CMYK toner printer may allow the conversion of: (1) a conversion of a CMYW machine that has combined toner and drum cartridges; (2) a conversion of a CMYW machine that has separate toner and drum cartridges; and (3) a conversion of a CMYW machine with a single drum and separate toner printing cartridges.

Regarding the conversion of a CMYW machine that has a separate toner and drum cartridges, the conversion may comprise replacing one or more of the color cartridges or the white cartridge with a black toner printing cartridge and replacing the accompanying drum with a black drum.

Regarding the conversion of a CMYW machine that has separate toner printing cartridges, but a single drum cartridge, the conversion may comprise replacing the white or one or more of the color cartridges with a black toner printing cartridge and cleaning the accompanying drum portion of the respective toner(s) and priming it with black toner(s).

In another embodiment, the one or more black toner printing cartridges may be provided by disassembling the removed printing cartridges to create one or more empty cartridges, which are then cleaned and refilled with a black toner.

In one embodiment, the starting cyan, yellow, magenta, and white toner printing cartridges are original/new cartridges. In another embodiment the starting cyan, yellow, magenta, and white toner printing cartridges themselves were previously used and/or refurbished.

In various embodiments the positioning of the non-standard toner cartridge(s) and the programming of the RIP software allows the user to print with the black toner cartridge(s) concurrently with the other colors in a single layer or print the black toner as a separate layer before and/or after the other colors have printed.

FIG. 1 is a flow block diagram of one embodiment of the method of converting a CMYW toner printer to print with a black toner with a single cartridge conversion. FIG. 1 shows that the method 1100 may comprise the steps: providing a CMYW toner printer with four toner printing cartridges, cyan (C), magenta (M), yellow (Y), and white (W) 1105; the cartridges may be in any order and the white cartridge may be in any position 1110; removing the white toner printing cartridge 1112; providing a non-standard toner printing cartridge 1115; installing the black toner printing cartridge into the cartridge position that is empty after the white cartridge was removed 1120; and providing raster image processor (RIP) software for cartridge remapping if necessary 1130.

The RIP software may allow the printer to recognize the non-standard toner printing cartridge and specifically incorporate that toner into the image.

The black toner cartridge may each have a chip that allows the printer to recognize that the black toner has replaced the white cartridge, so that RIP software may automatically recognize that black has been put into the printer to replace the white toner cartridge. In other embodiments, the user may manually enter into the RIP software where the black toner was inserted into the printer. The RIP software is configured to allow the printer to print images that incorporate the black toner. In some embodiments, the user may move around the three starting color toners after taking out the white toner. The black toner is then inserted into the empty slot and the RIP software is used to remap the printer.

Figure 2:
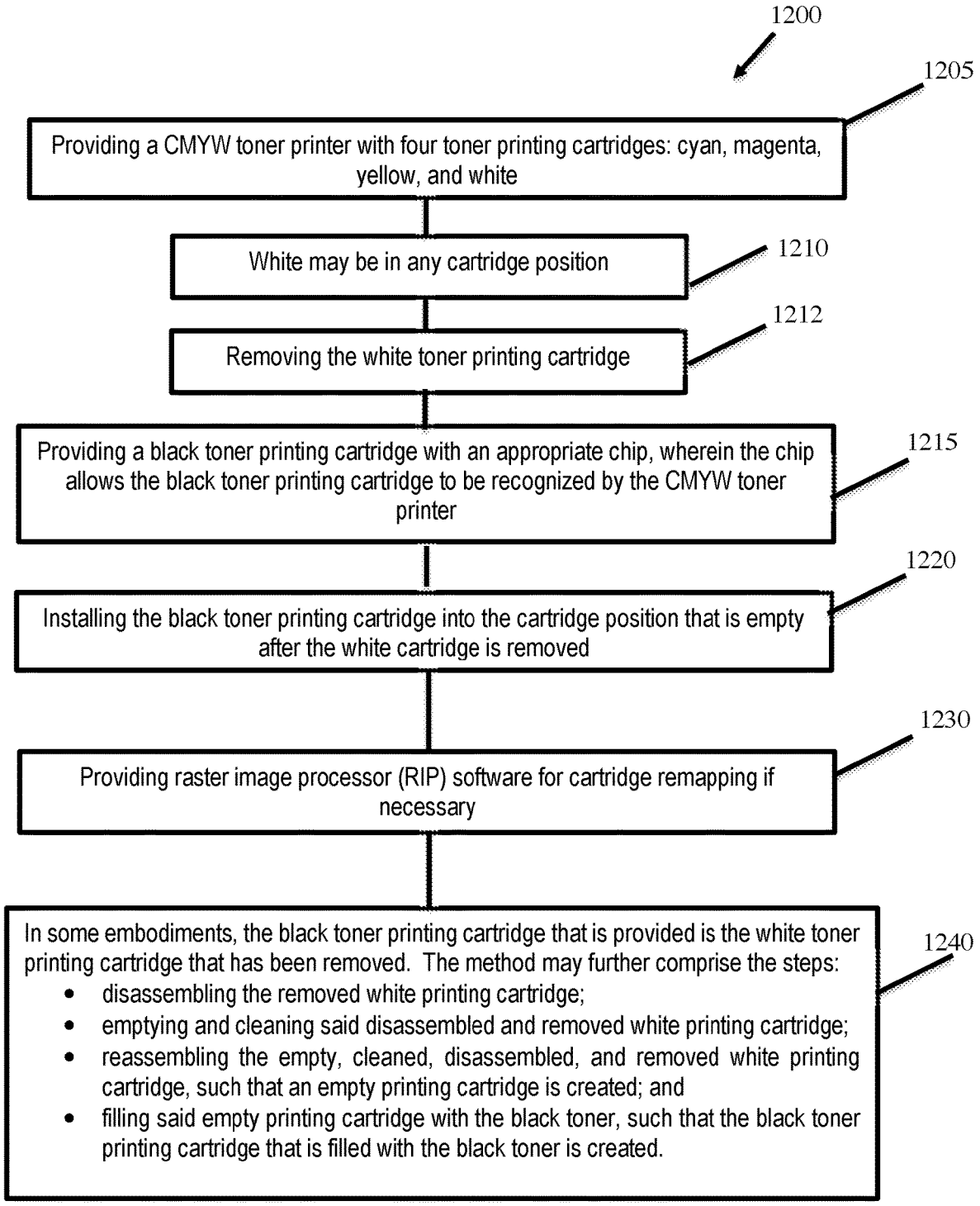
FIG. 2 is a flow block diagram of one embodiment of the method of converting a CMYW toner printer to a CMYK toner printer.

FIG. 2 is a flow block diagram of one embodiment of the method of converting a CMYW toner printer to a CMYK toner printer. FIG. 2 shows that the method 1200 may comprise the steps: providing a CMYW toner printer with four toner printing cartridges, cyan (C), magenta (M), yellow (Y), and white (W) 1205; the cartridges may be in any order and the white cartridge may be in any position 1210; removing the white toner printing cartridge 1212; providing a black toner printing cartridge with an appropriate chip, wherein the chip allows the black toner printing cartridge to be recognized by the CMYW toner printer 1215; installing the black toner printing cartridge into the cartridge position that is empty after the white cartridge was removed 1220; providing raster image processor (RIP) software for cartridge remapping if necessary 1230; the RIP software may: (1) allow the printer to recognize the black toner printing cartridge and specifically incorporate that toner into the image. The black toner may have a chip that allows the printer to recognize that the black toner has replaced the white cartridge. In other embodiments, the user may manually enter into the RIP software that the black toner was inserted into the printer. The RIP software is configured to allow the printer to print images that incorporate the black toner. In some embodiments, the user may move around the three color toners after taking out the white toner. The black toner is then inserted into the empty slot and the RIP software is used to remap the printer.

In some embodiments 1240, the black toner printing cartridge that is provided is the white toner printing cartridge that has been removed. The method may further comprise the steps:

disassembling the removed white printing cartridge;

emptying and cleaning said disassembled and removed white printing cartridge;

reassembling the empty, cleaned, disassembled, and removed white printing cartridge, such that an empty printing cartridge is created; and filling said empty printing cartridge with the black toner, such that the black toner printing cartridge that is filled with the black toner is created.

Figure 3:
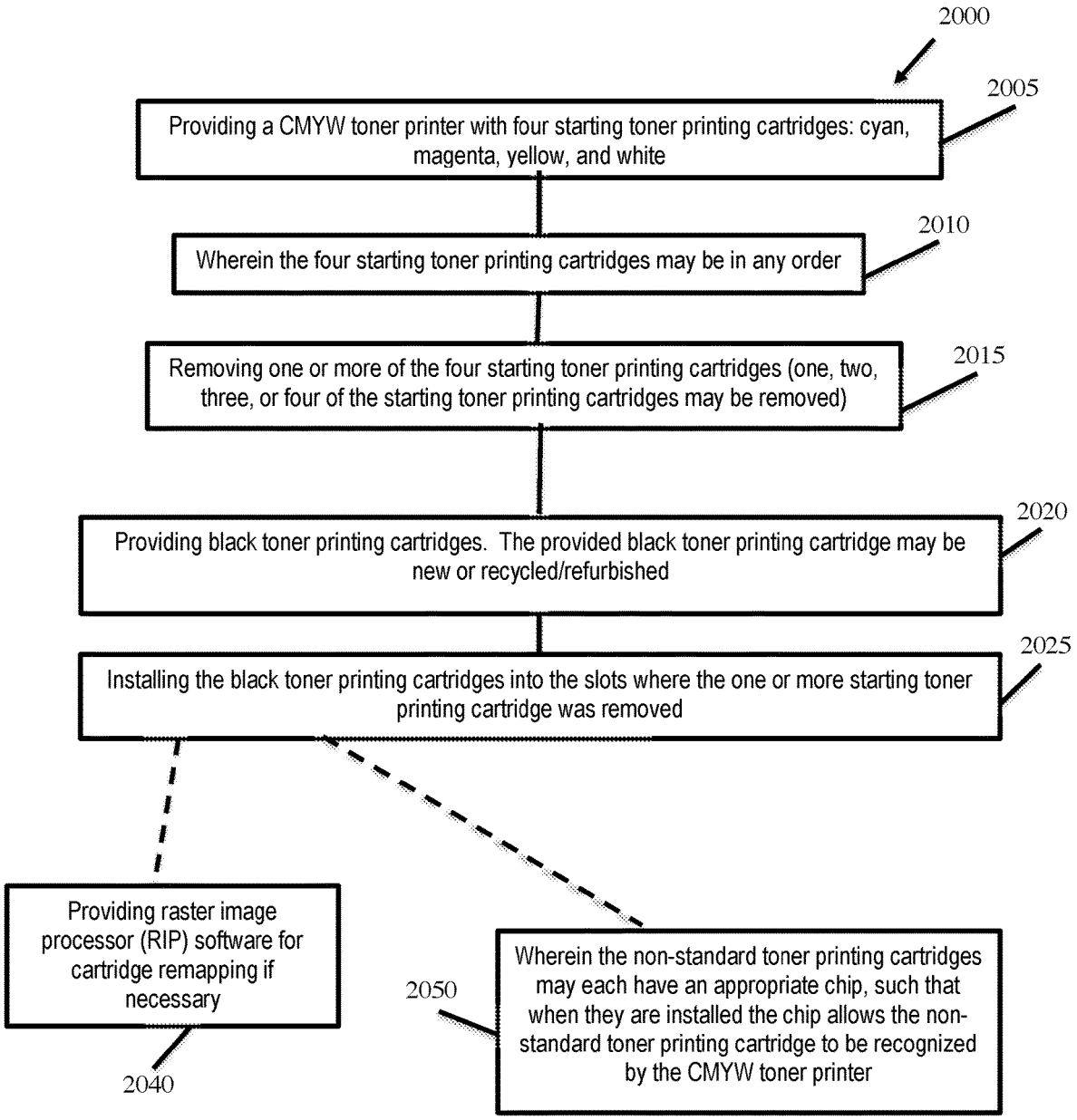
FIG. 3 is a flow block diagram of one embodiment of the method of converting a CMYW toner printer to print with black toner printing cartridge.

FIG. 3 is a flow block diagram of one embodiment of the method of converting a CMYW toner printer to print with black toner printing cartridge. FIG. 3 shows that the method of converting a CMYW toner printer 2000 may comprise the steps: providing a CMYW toner printer with four toner printing cartridges: cyan (C), magenta (M), yellow (Y), and white (W) 2005; wherein the four toner printing cartridges may be in any order 2010 within the CMYW toner printer; removing one or more of the four toner printing cartridges (one, two, three, or four of the starting toner printing cartridges may be removed) 2015; providing a black toner printing cartridge; the provided black toner printing cartridge may be new or recycled/refurbished 2020; and installing the black toner printing cartridge into the slot or one of the slots where the one or more starting toner printing cartridges were removed 2025. In some embodiments, the method may further comprise providing raster image processor (RIP) software for cartridge remapping if necessary 2040. In another embodiment, the black toner printing cartridges each have an appropriate chip, such that when it is installed the chip allows the black toner printing cartridge to be recognized by the CMYW toner printer 2050.

Figure 4:
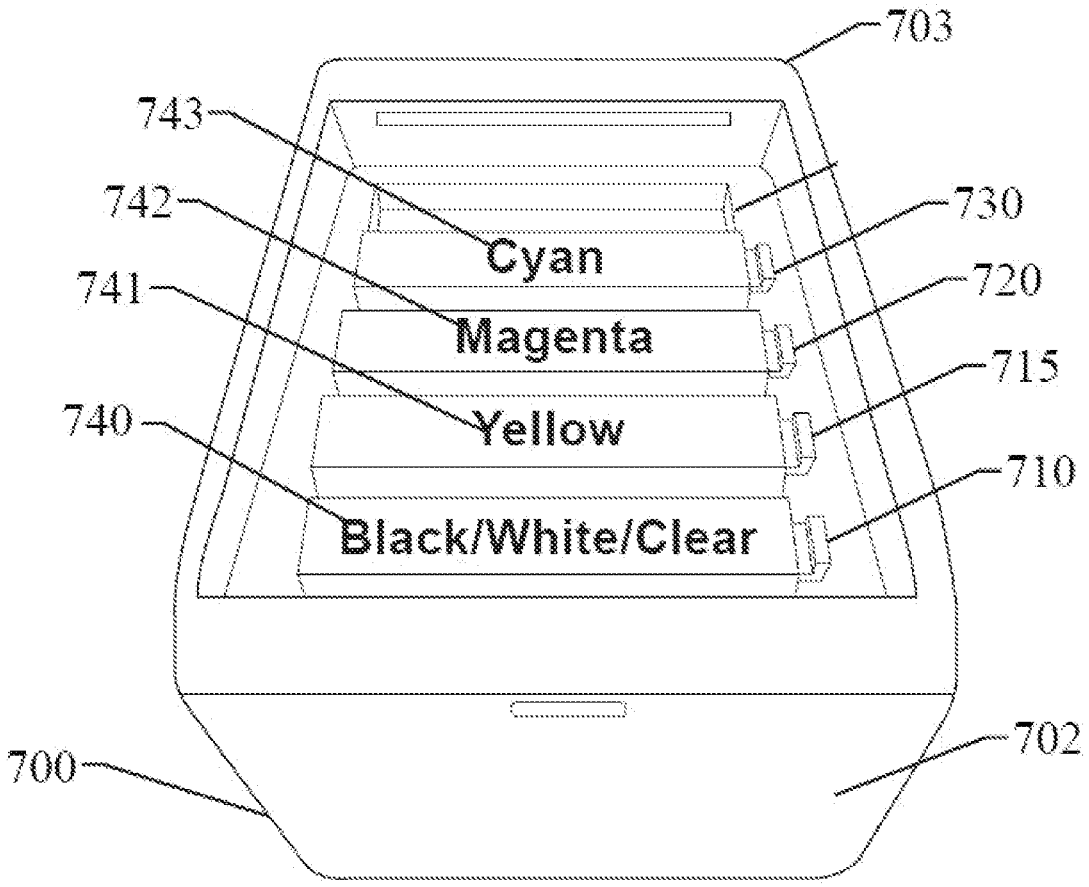
FIG. 4 is an illustration of one embodiment of a printer.
Figure 5:
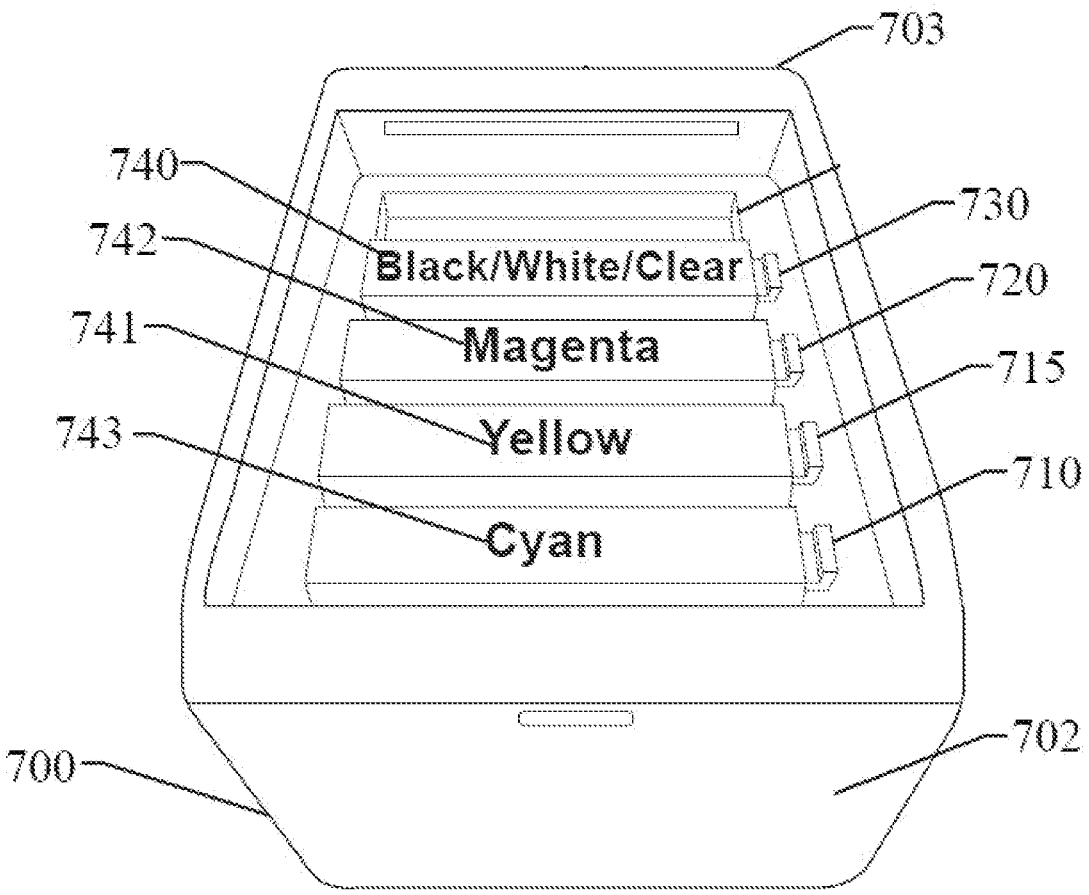
FIG. 5 is an illustration of another embodiment of a printer.

In some embodiments, the method may comprise, as examples and not by limitation:

removing all four starting toner cartridges and replacing them with four CMYK sublimation toner cartridges removing all four starting toner cartridges and replacing them with three CMY fluorescent cartridges and a black toner cartridge removing all four starting toner cartridges and replacing them with three CMY light/pastel cartridges and a black toner cartridge removing the three CMY colored cartridges and replacing them with CMY fluorescent cartridges removing the three CMY colored cartridges and replacing them with three CMY light/pastel cartridges removing the yellow cartridge and replacing it with gold metallic removing the white cartridge and replacing it with black any combination of the above and the swapping may or may not include matching similar incoming toners to the outgoing toners FIG. 4 is an illustration of one embodiment of a CMYW printer 700 with four toner cartridges, white 740, yellow 741, magenta 742, and cyan 743, which are in, respectively, cartridge slots 710, 715, 720, and 730. One or more of the cartridges 740, 741, 742, 743 may be removed and another cartridge may be swapped in, such as black or clear (which is an X cartridge). FIG. 4 shows that the white 740 cartridge may start (or end up in) the first slot at the front 702 of the printer 700. FIG. 5 shows the white 740 may start (or end up in) the last slot at the rear 703 of the printer 700.

FIG. 5 is an illustration of another embodiment of a CMYW printer 700 with four toner cartridges, white 740, magenta 742, yellow 741, and cyan 743, which are in, respectively, cartridge slots 730, 720, 715, and 710. One or more of the cartridges 740, 741, 742, 743 may be removed and another cartridge may be swapped in, such as black or clear (which is an X cartridge). FIG. 5 shows the white 740 may start (or end up in) the last slot at the rear 703 of the printer 700.

In some embodiments, the removed starting toner Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A method of converting a CMYW toner printer to print with black toner, comprising the steps:

providing a CMYW toner printer;

wherein said CMYW toner printer has four starting toner printing cartridges;

wherein said four starting toner printing cartridges comprise a white toner printing cartridge, a cyan toner printing cartridge, a magenta toner printing cartridge, and a yellow toner printing cartridge;

removing at least one of said four starting toner printing cartridges from said CMYW toner printer, such that there is at least one empty toner cartridge slot;

providing a black toner printing cartridge that is filled with black toner;

installing said black toner printing cartridge into said at least one empty toner cartridge slot;

providing raster image processor (RIP) software, such that said CMYW toner printer is able to incorporate said black toner into one or more images printed by said CMYW toner printer; and wherein said RIP software allows for remapping of said CMYW toner printer, such that the converted toner printer prints using said black toner in single pass.

2. The method of claim 1, wherein said CMYW toner printer is a laser toner printer.

3. The method of claim 1, wherein said CMYW toner printer is an LED toner printer.

4. A method of converting a cmyw toner printer to print with black toner, comprising the steps:

providing a CMYW toner printer;

wherein said CMYW toner printer has four starting toner printing cartridges;

wherein said four starting toner printing cartridges comprise a white toner printing cartridge, a cyan toner printing cartridge, a magenta toner printing cartridge, and a yellow toner printing cartridge;

removing at least one of said four starting toner printing cartridges from said CMYW toner printer, such that there is at least one empty toner cartridge slot;

providing a black toner printing cartridge that is filled with black toner;

installing said black toner printing cartridge into said at least one empty toner cartridge slot and wherein said black toner printing cartridge has an appropriate chip, such that when said black toner printing cartridge is installed in said CMYW printer said appropriate chip is configured to allow said black toner printing cartridge to be recognized by said CMYW toner printer, such that the CMYW toner printer prints using said black toner in single pass.

5. A method of converting a CMYW toner printer to print with black toner, comprising the steps:

providing a CMYW toner printer;

wherein said CMYW toner printer has four starting printing cartridges;

wherein said four starting printing cartridges comprise a white toner printing cartridge, a cyan toner printing cartridge, a magenta toner printing cartridge, and a yellow toner printing cartridge;

removing said white toner printing cartridge from said CMYW toner printer, such that there is an empty toner cartridge slot;

providing a black toner printing cartridge that is filled with a black toner;

installing said black toner printing cartridge into said empty toner cartridge slot;

providing raster image processor (RIP) software, such that said CMYW toner printer is able to incorporate said black toner into one or more images printed by said CMYW toner printer; and wherein said RIP software allows for remapping of said CMYW toner printer, such that the converted toner printer prints using said black toner in single pass.

6. The method of claim 5, wherein said black toner printing cartridge that is provided is said white toner printing cartridge that has been removed;

wherein said method further comprising the steps:

disassembling said removed white printing cartridge;

emptying and cleaning said disassembled and removed white printing cartridge;

reassembling said empty, cleaned, disassembled, and removed white printing cartridge, such that an empty printing cartridge is created; and filling said empty printing cartridge with said black toner, such that said black toner printing cartridge that is filled with said black toner is created.

7. The method of claim 6, wherein said CMYW toner printer is a laser toner printer.

8. The method of claim 6, wherein said CMYW toner printer is an LED toner printer.

9. The method of claim 5, wherein said CMYW toner printer is a laser toner printer.

10. The method of claim 5, wherein said CMYW toner printer is an LED toner printer.

11. A method of converting a CMYW toner printer to print with black toner, comprising the steps:

providing a CMYW toner printer;

wherein said CMYW toner printer has four starting printing cartridges;

wherein said four starting printing cartridges comprise a white toner printing cartridge, a cyan toner printing cartridge, a magenta toner printing cartridge, and a yellow toner printing cartridge;

removing said white toner printing cartridge from said CMYW toner printer, such that there is an empty toner cartridge slot;

providing a black toner printing cartridge that is filled with a black toner;

installing said black toner printing cartridge into said empty toner cartridge slot; and wherein said black toner printing cartridge has an appropriate chip, such that when said black toner printing cartridge is installed in said CMYW printer said appropriate chip is configured to allow said black toner printing cartridge to be recognized by said CMYW toner printer, such that the CMYW toner printer prints using said black toner in single pass.

12. The method of claim 11, wherein said black toner printing cartridge that is provided is said white toner printing cartridge that has been removed;

wherein said method further comprising the steps:

disassembling said removed white printing cartridge;

emptying and cleaning said disassembled and removed white printing cartridge;

reassembling said empty, cleaned, disassembled, and removed white printing cartridge, such that an empty printing cartridge is created; and filling said empty printing cartridge with said black toner, such that said black toner printing cartridge that is filled with said black toner is created.

* * * * *